US005242885A

United States Patent [19]

Shinmitsu et al.

[11] Patent Number: 5,242,885

[45] Date of Patent: Sep. 7, 1993

[54] PRESSURE SENSITIVE RECORDING SHEET WITH A LAYER CONTAINING MICROCAPSULES EACH CONTAINING COLOR FORMER AND BENZYL TOLUENE

[75] Inventors: Kazuyuki Shinmitsu, Kobe; Masanao Tajiri, Akashi; Shunsuke Shioi, Ikoma, all of Japan

[73] Assignee: Kanzaki Paper Manufacturing Co., Ltd., Tokyo, Japan

[21] Appl. No.: 879,119

[22] Filed: May 5, 1992

Related U.S. Application Data

[63] Continuation of Ser. No. 420,003, Oct. 11, 1989, abandoned.

[30] Foreign Application Priority Data

Oct. 14, 1988 [JP] Japan ..... 63-259953

[51] Int. Cl.[5] ..... B41M 5/165

[52] U.S. Cl. ..... 503/213; 503/215; 503/226

[58] Field of Search ..... 427/150–152; 503/213, 215, 226

[56] References Cited

U.S. PATENT DOCUMENTS 4,197,346 4/1980 Stevens ..... 428/914

FOREIGN PATENT DOCUMENTS 58-11190 1/1983 Japan ..... 503/213

*Primary Examiner*—B. Hamilton Hess

*Attorney, Agent, or Firm*—Wenderoth, Lind & Ponack

[57] ABSTRACT

An improved pressure sensitive recording sheet capable of causing an improved color development which comprises a substrate and a layer containing microcapsules each containing an electron-donative chromogenic material and a hydrophobic medium containing benzyl toluene being formed on the substrate.

The pressure sensitive recording sheet exhibits an excellent color-developing property and provides clear color images of high density.

2 Claims, No Drawings

PRESSURE SENSITIVE RECORDING SHEET WITH A LAYER CONTAINING MICROCAPSULES EACH CONTAINING COLOR FORMER AND BENZYL TOLUENE

This application is a continuation of now abandoned application Ser. No. 07/420,003 filed on Oct. 11, 1989.

FIELD OF THE INVENTION

The present invention relates to a pressure sensitive recording sheet having a layer containing microcapsules formed on a substrate by printing. More particularly, the present invention relates to an improved pressure sensitive recording sheet having a layer containing microcapsules each containing an electron-donative chromogenic material and a hydrophobic medium containing benzyl toluene, which recording sheet excels in the color developing property and which provides clear color images of high density.

BACKGROUND OF THE INVENTION

There are various kinds of pressure sensitive recording sheets known for transmitting information wherein a color-forming reaction between a plurality of chromogenic materials, for example, between an electron-acceptive reactant material (hereinafter referred to as "color acceptor") such as activated clay, phenol-formaldehyde condensate, polyvalent metal salts of aromatic carboxylic acids, etc. and an electron donative chromogenic material (hereinafter referred to as "color former") such as Crystal Violet lactone, N-benzoyl leucomethylene blue, etc. is utilized and pressure serves as a medium to provide expected color images.

Any of these known pressure sensitive recording sheets comprise (i) a top sheet (CB) comprising a substrate having a surface coated with a layer containing microcapsules each containing a color former prepared by the known coacervation method, interfacial polymerization method or in-situ polymerization method and (ii) a bottom sheet (CF) having a surface coated with a layer containing a color acceptor capable of reacting with said color former to cause color development, and if necessary, in addition to said two sheets, (iii) a middle sheet (CFB) having a surface coated with a layer containing the foregoing microcapsules and another surface coated with a layer containing a color acceptor, and the top sheet and at least one of the bottom and middle sheets are used in combination.

Other than the above pressure sensitive recording sheets, there has been proposed a so-called self-contained type pressure sensitive recording sheet comprising a substrate having a surface provided with a two layers-stacked structure or a mixed layer structure including the foregoing microcapsules and a color acceptor.

There has been also proposed a self-contained type pressure sensitive recording sheet set comprising the foregoing self-contained type pressure sensitive recording sheet, the rear surface of which is coated with a layer containing the foregoing microcapsules, the foregoing bottom sheet (CF) or/and the foregoing middle sheet (CFB) in combination.

For the preparation of these pressure sensitive recording sheets in general, an appropriate aqueous coating composition is applied onto the surface of a substrate with the use of a large coater, which is then followed by drying.

Other than this method, for the preparation of a pressure sensitive recording sheet having a layer containing microcapsules each containing a color former, there has been proposed a method wherein an ink composition containing said microcapsules is prepared, and the resultant ink composition is spot-printed onto a substrate by means of an appropriate printer such as Business-form printer, followed by drying.

This method is more advantageous in comparison with the former method using a large coater from the viewpoint that it is possible to prepare such a pressure sensitive recording sheet that has a surface with partially varied color tones as desired and it is also possible to prepare such a pressure sensitive recording sheet that can exhibit desired characteristics upon its use.

On the contrary, there are disadvantages of this method: (a) the amount of microcapsules to be applied is apt to become insufficient and because of this, the resulting pressure sensitive recording sheet is poor in color development (which means that it is difficult to provide a desirable high density color image), (b) unevenness is apt to be caused on a printed coat formed on a substrate, and (C) the insufficiency of the amount of microcapsules applied and the uneven coating are apt to jointly occur and as a result, the resulting pressure sensitive recording sheet provides undesirably unclear color images.

SUMMARY OF THE INVENTION

The present invention is aimed at eliminating the foregoing disadvantages in the conventional pressure sensitive recording sheet having a layer containing a capsule ink composition and providing an improved pressure sensitive recording sheet.

Another object of the present invention is to provide an improved pressure sensitive recording sheet which excels in the color-developing property and provides clear color images of high density.

A further object of the present invention is to provide an improved pressure sensitive recording sheet which is provided with a layer containing microcapsules each containing an electron donative chromogenic material (color former) and a hydrophobic medium containing benzyl toluene.

A still further object of the present invention is to provide an improved pressure sensitive recording sheet which is provided with a layer formed from a capsule ink composition containing microcapsules each containing an electron-donative chromogenic material (color former) and a hydrophobic medium containing benzyl toluene, by means of a printing technique such as flexographic printing or gravure printing.

The present inventors have made intensive studies in order to achieve the above objects and as a result, found that when a capsule ink composition containing microcapsules each containing an electron-donative chromogenic material (color former) and a hydrophobic medium comprising benzyl toluene as a core material thereof is prepared and a pressure sensitive recording sheet having a layer formed from the capsule ink composition by means of a printing technique such as flexographic printing or gravure printing, there is afforded a desirable pressure sensitive recording sheet which is free of the foregoing problems which are found on the conventional pressure sensitive recording sheet and which provides clear color images of high density.

The present invention has been accomplished based on the above finding.

The pressure sensitive recording sheet provided according to the present invention is characterized by having a layer formed from a capsule ink composition containing microcapsules each containing an electron-donative chromogenic material and a hydrophobic medium comprising benzyl toluene as a core material (this layer hereinafter will be referred to as "microcapsule-containing layer"). The pressure sensitive recording sheet thus constituted of the present invention is excellent in the color-developing property and provides desirably clear colored-recorded images of high density.

DESCRIPTION OF THE INVENTION

The microcapsule-containing layer of the pressure sensitive recording sheet according to the present invention may be appropriately formed by providing microcapsules prepared with the use of a core material obtained by dissolving a proper electron-donative chromagenic material (color former) in a selected specific hydrophobic medium, that is benzyl toluene, dispersing the microcapsules in a vehicle to obtain a capsule ink composition and applying the resultant capsule ink composition onto a substrate.

The main feature of the present invention is to selectively use benzyl toluene as the hydrophobic medium for a microcapsule and the use of benzyl toluene makes the pressure sensitive recording sheet exhibit an excellent color-developing property and provide desirable clear colored images of high density.

In the most preferred embodiment for the hydrophobic medium in the present invention, benzyl toluene is solely used. However, it is possible to use benzyl toluene and one or more of other hydrophobic mediums in combination.

The object of the present invention can be desirably attained also in the latter case.

Examples of such hydrophobic medium which can be used together with benzyl toluene are, for example, vegetable oils such as cotton seed oil; mineral oils such as kerosene, paraffin oil, naphthene oil and chlorinated paraffin; aromatic hydrocarbons such as alkylated biphenyl, alkylated terphenyl, alkylated naphthalene, diaryl ethane and triaryl methane; and esters such as dimethyl phthalate, diethyl phthalate, di-n-butyl phthalate, dioctyl phthalate, diethyl adipate, propyl adipate, di-n-butyl adipate and dioctyl adipate.

In any case, it is necessary for the hydrophobic medium used to contain preferably 20% by weight or more, or more preferably, 50% by weight of benzyl toluene, in order for the resulting pressure sensitive recording sheet to exhibit a desired color-developing property.

As the foregoing electron-donative chromogenic material (color former) to be used in the present invention, any of the known colorless or pale-colored basic dyes in the field of pressure sensitive recording sheet can be selectively used. Examples of such basic dyes are:

Triarylmethane-based dyes, e.g., 3,3-bis(p-dimethylaminophenyl)-6-dimethylaminophthalide, 3-(p-dimethylaminophenyl)-3-(1,2-dimethylindole-3-yl)phthalide, 3,3-bis(1,2-dimethylindole-3-yl)-5-dimethylaminophthalide, 3,3-bis(9-ethylcarbazole-3-yl)-6 dimethylaminophthalide, etc.

Diphenylmethane-based dyes, e.g., 4,4'-bis-dimethylamino-benzhydryl benzyl ether, N 2,4,5-trichlorophenylleucoauramine, etc.

Thiazine-based dyes, e.g., benzoyl-leucomethyleneblue, p-nitrobenzoyl-leucomethyleneblue, etc.

Spiro-based dyes, e.g., 3-methyl-spiro-dinaphthopyran, 3-phenyl-spiro-dinaphthopyran, 3-propyl-spiro-dibenzopyran, etc.

Lactam-based dyes, e.g., rhodamine-B-anilinolactam, rhodamine-(p-nitroanilino)lactam, rhodamine-(o-chloroanilino)lactam, rhodamine-(0-chloroanilyl)lactam, etc.

Fluoran-based dyes, e.g., 3-dimethylamino-7-methoxyfluoran, 3-diethylamino-6-methyl-7-chlorofluoran, 3-(N-ethyl-p-toluidino)-7-methylfluoran, 3 diethylamino-7-N-methylaminofluoran, 3-diethylamino-7-dibenzylaminofluoran, 3-(N-ethyl-p-toluidino)-6-methyl-7-phenylaminofluoran, 3-diethylamino-t-methyl-7-phenylaminofluoran, 3-(N-cyclohexyl-N-methylamino)-6-methyl-7 phenylaminofluoran, 3-piperidino-methyl-7-phenylaminofluoran, 3-diethylamino-6-methyl-7-xylidinofluoran, etc.

These basic dyes may be used alone or in combination as a mixture of two or more of them.

The amount of one or more of these basic dyes as the electron-donative chromogenic material (color former) to be incorporated in the foregoing hydrophobic medium is properly determined depending upon the color developing ability of the basic dye used.

However, in general, it is preferably in the range of from 1 to 100 parts by weight versus 100 parts by weight of the hydrophobic medium.

The microcapsule used in the present invention may be prepared by any of the known microcapsule-making methods, e.g., the coacervation method disclosed in U.S. Pat. Nos. 2,800,457 or 2,800,458; the interfacial polymerization method disclosed in Japanese Patent Publications Nos. 19574/1963, 446/1957 or 771/1967 or U.S. Pat. No. 3,796,669; and the insitu polymerization method disclosed in Japanese Patent Publication No. 9168/1961 or U.S. Pat. Nos. 4,001,140 or 4,100,103.

For example, the microcapsule used in the present invention is prepared by emulsifying a hydrophobic liquid comprising one or more of the foregoing basic dyes (electron-donative chromogenic material: color former) dissolved in the foregoing hydrophobic medium in the form of fine droplets in an aqueous medium containing an emulsifier and a melamine-formaldehyde resin precondensate, condensing said resin precondensate under acidic conditions with heating and accumulating the resin film around the fine droplet surface of the hydrophobic liquid.

The mean particle size of the microcapsule used in the present invention is, in general, preferably in the range of from 0.5 to 15 μm and more preferably in the range of from 1 to 5 μm. However, in the case of using the microcapsule in the form of a flexographic or gravure capsule ink composition, it is preferably in the range of from 1 to 4 μm.

The microcapsule used in the present invention may contain an antioxidant, ultraviolet ray absorbing agent, resin, etc. in case where necessary.

The capsule ink composition used in the present invention may be aqueous or non-aqueous.

However, there is a disadvantage in using an aqueous microcapsule ink composition in that when a paper sheet is used as the substrate, the paper sheet is apt to crumple upon spot printing the ink composition thereon. On the other hand, such disadvantage is not caused in the case of using the non-aqueous system capsule ink composition even when it is spot printed on the paper sheet. In view of this, the non-aqueous capsule ink composition is rather desirable.

The non-aqueous capsule ink composition may be prepared, for example, in the following manner. That is, a dispersion containing the microcapsules each containing the foregoing electron-donative chromogenic material and the foregoing hydrophobic medium is filtrated or air-dried to obtain powdery microcapsules. The powdery microcapsules thus obtained are then dispersed in a vehicle such as volatile organic solvent, polymerizable organic solvent, oil, resin or wax to obtain a dispersion. Where necessary, the dispersion thus obtained may also contain an adjuvant such as pigment, capsule protective material photo polymerization initiator, sensitizer, ultraviolet ray absorbing agent, antioxidant, fluorescence dye stuff, gelatinizer, etc. Thus, there can be obtained a capsule ink composition of evaporation to dryness type, ultraviolet ray-curing type, oxidation polymerization type or hot-melt type.

The non-aqueous capsule ink composition thus prepared is applied onto a substrate by means of a proper printing machine of flexographic printing, typographic printing gravure printing, offset printing or screen process printing. In the case where the microcapsule containing layer is formed by applying the non-aqueous capsule ink composition onto the substrate by means of flexographic printing or gravure printing, the object of the present invention can be effectively attained. Further, in the case where the microcapsule-containing layer is formed by applying the non-aqueous capsule ink composition of evaporation to dryness type or ultraviolet ray curable type onto the substrate by way of flexographic printing or gravure printing, the object of the present invention can be most effectively attained.

In the above preparation of a non-aqueous capsule ink composition of evaporation to dryness type, the foregoing powdery microcapsules are dispersed in a vehicle comprising a volatile organic solvent and a resin. Likewise, in order to obtain a non-aqueous capsule ink composition of ultraviolet ray curable type, the foregoing powdery microcapsules are dispersed in a vehicle comprising a polymerizable organic solvent.

It is possible for the pressure sensitive recording sheet of the present invention to be made such that it develops two or more different colors at the same time. In this case, its microcapsule-containing layer is formed by providing the plural kinds of capsule ink compositions each containing a different electron-donative chromogenic material (color former) capable of developing a different color tone, and separately spot-printing those capsule ink compositions onto a substrate.

In the present invention, the surface of a substrate onto which the foregoing capsule ink composition is printed to form a desired microcapsule-containing layer can be the surface of a paper sheet made by an acidic paper-making method or a neutral paper-making method, synthetic paper or plastic film, or other than these, the rear face of the bottom sheet, or the surface of a capsule layer of the top sheet or the middle sheet.

The amount of the foregoing capsule ink composition to be applied onto the surface of such object is not particularly limited. However, not only rom a viewpoint of the color developing property but also from an economical viewpoint, the pressure sensitive recording sheet is preferably in the range of from 0.5 to 10 g/m$^2$ and most preferably prepared by applying an amount of the capsule ink composition, in the range of from 1 to 5 g/m$^2$ on a dry weight basis.

As the foregoing vehicle in which the foregoing microcapsules are dispersed, one or more members selected from the group consisting of a volatile organic solvent, oil, resin, polymerizable organic solvent and wax can be used.

Examples of the useful volatile organic solvents are, for example, benzene, toluene, xylene, cyclohexane, hexane, ligroin, methyl isobutyl ketone, methyl acetate, ethyl acetate, butyl acetate, methyl cellosolve, ethyl cellosolve, butyl cellosolve, diethylene glycol monobutyl ether, diethylene glycol monobutyl ether acetate, methanol, ethanol, n-propyl alcohol, isopropyl alcohol, n-butanol, n-hexanol, cyclohexanol and 2-ethyl-hexyl alcohol.

Examples of the useful oils are, for example, vegetable oils such as linseed oil, safflower oil and like drying oil, soybean oil and like semi-drying oil and castor oil and like non-drying oil; process oils such as dehydrated castor oil, polymerized oil, maleinized oil, vinylation oil and urethanated oil; mineral oils such as machine oil and spindle oil.

Examples of the useful resins are, for example, natural resins such as rosin (gum rosin, wood rosin, tall oil rosin), shellac, copal, dammar, gilsonite and zein; semi-synthetic resins such as hardened rosin, ester gum and other rosin esters, maleic acid resin, fumaric acid resin, dimer rosin, polymer rosin, rosin-modified phenol resin, methyl cellulose, ethyl cellulose, hydroxyethyl cellulose, hydroxypropyl cellulose, ethyl hydroxyethyl cellulose, carboxymethyl cellulose, cellulose acetate propionate, cellulose acetate butyrate and nitrocellulose; synthetic resins such as phenolic resin, xylenic resin, urea resin, melamine resin, ketone resin, coumarone-indene resin, petroleum resin, terpene resin, cyclized rubber, rubber chloride, alkyd resin, polyamide resin, acrylic resin, polyvinyl chloride, vinyl chloride-vinyl acetate copolymer, polyvinyl acetate, ethylene-maleic anhydride copolymer, styrene-maleic anhydride copolymer, methyl vinyl ether-maleic anhydride copolymer, isobutylene-maleic anhydride copolymer, polyvinyl alcohol, modified polyvinyl alcohol, polyvinyl butyral (butyral resin), polyvinyl pyrrolidone, chlorinated polypropylene, styrene resin, epoxy resin and polyurethane.

Examples of the useful polymerizable organic solvents are, for example, polyethyleneglycoldiacrylate, propyleneglycoldimethacrylate, pentaerythritolacrylate, trimethlolpropanediacrylate, pentaerythritoltetracrylate, hexandioldiacrylate, 1,2-buthanediolacrylate, reaction product of epoxy resin and acrylic acid, reaction product of methacrylic acid, penthaerythritol and acrylic acid, condensate of maleic acid and diethylene glycol, methymethacrylate, butylmethacrylate, and oligomers or prepolymers having ethylenic unsaturated group.

Examples of the useful waxes are, for example, animal waxes such as bees wax, spermaceti and lanolin; vegetable waxes such as candelilla wax, carnauba wax, Japan wax, rice wax and sugar cane wax; mineral waxes such as montan wax and ozocerite; petroleum waxes such as paraffin wax and microcrystalline wax; modified waxes such as montan wax derivative, paraffin wax derivative and microcrystalline wax derivative; hydrogenated waxes such as castor wax and opal wax; synthetic waxes such as low-molecular weight polyethylene and derivative thereof and distearyl ketone; fatty acid amide waxes such as caproic acid amide, caprylic acid amide, pelargonic acid amide, capric acid amide, lauric acid amide, tridecylic acid amide, myristic acid amide, stearic acid amide, behenic acid amide, ethylene-bis(stearic acid amide), oleic acid amide, linoleic acid amide, ricinoleic acid amide and linolenic acid amide; fatty acid waxes such as stearic acid and behenic acid; alcohol waxes such as stearyl alcohol; phosphate waxes such as distearyl phosphate. These waxes can be used singly, or at least two of them can be used in admixture.

As for the bottom sheet to be used in combination with the pressure sensitive recording sheet of the present invention which comprises a substrate and the foregoing specific microcapsule-containing layer formed on said substrate by means of printing technique, it comprises a substrate and a layer containing an electron-acceptive reactant material (color acceptor) capable of reacting with the electron-donative chromogenic material (color former) contained in the microcapsule of the pressure sensitive recording sheet of the present invention to cause color development, which is formed on said substrate by applying an aqueous or non-aqueous dispersion containing said color acceptor onto the substrate.

As the above electron-acceptive reactant material (color acceptor) to be used for the bottom sheet, any of known materials as the electron-acceptive reactant material in the field of pressure sensitive recording sheet can be properly used.

Usable as such electron-acceptive reactant material are, for example, acidic clay, activated clay and bentonite, phenol resins, polyvalent metal salts of aromatic carboxylic acids disclosed in Japanese Patent Publication No. 25174/1976, and zinc salts of 2,2'-bisphenolsulfone compounds disclosed in Japanese Patent Publication No. 106316/1979. These materials can be used singly, or two or more of them can be used in admixture.

The coating composition used for the formation of the foregoing layer for the bottom sheet may be prepared using the foregoing electron-acceptive reactant material (color acceptor), binder and pigment which are known in the field of pressure sensitive recording sheet, and in case where necessary, further using one or more adjuvants such as a dispersant, interfacial active agent, ultraviolet ray absorbing agent, fluorescent brightener, thickener, antifoamer, etc. which are all known in the field of pressure sensitive recording sheet.

The coating composition thus prepared is applied onto a substrate, i.e. a paper sheet prepared by an acidic paper-making method or a neutral paper making method, a synthetic paper or a plastic film by means of a known coater to thereby form a coated layer, which is followed by drying, whereby a sheet comprising a substrate and an electron-acceptive reactant material-containing layer formed on said substrate to be the bottom sheet is obtained.

The amount of the coating composition containing an electron-acceptive reactant material (color acceptor) is not particularly limited. However, in general, it is preferably in the range of 0.2 to 15 g/m$^2$, and more preferably, in the range of from 1 to 10 g/m$^2$ on a dry weight basis.

The amount of the electron-acceptive reactant material (color acceptor) in the coating composition used for the formation of the color acceptor-containing layer of the bottom sheet is adjusted to be preferably in the range of from 2 to 80% by weight or more preferably in the range of from 5 to 40% by weight versus the total amount of solids contained in said coating composition on a dry weight basis.

The pressure sensitive recording sheet of the present invention is used as the top sheet or the middle sheet which are so called in the field of pressure sensitive recording sheet.

PREFERRED EMBODIMENTS OF THE INVENTION

The advantages of this invention are now described in more detail by reference to the following Examples and Comparative Examples, which are provided here for illustrative purposes only, and are not intended to limit the scope of this invention.

Unless otherwise indicated, parts and % signify parts by weight and % by weight respectively.

EXAMPLE 1

(1) Preparation of a non aqueous capsule ink composition containing microcapsules each having a wall film of melamine-formaldehyde resin and containing an electron-donative chromogenic material (color former).

8 parts of crystal violet lactone was dissolved in 100 parts of benzyl toluene (trade name: JARYSOL-BT-01, product of ATOKEM Co., Ltd.) while heating to thereby obtain an inner-phase oil. To 200 parts of 3.0% aqueous solution of ethylene-maleic anhydride copolymer (trade name: EMA-31, product of Monsanto Co., Ltd.) was dropwise added 20% aqueous solution of sodium hydroxide to adjust the pH value to 6.0. In the solution thus obtained, the above inner-phase oil was emulsified to obtain an emulsion, which was followed by heating to 55° C.

Separately, 15 parts of melamine was added to 45 parts of 37% aqueous solution of formaldehyde to obtain a mixture, and the mixture was engaged in reaction at 60° C. for 15 minutes to thereby obtain a prepolymer aqueous solution.

The prepolymer aqueous solution thus obtained was dropwise added to the above emulsion maintained at 55° C. and thereto added dropwise 0.1N HCl while stirring to adjust the pH value to 5.3. The mixture was heated to 80° C. and maintained at this temperature for an hour. Then, the pH value of the mixture was adjusted to 3.5 with the addition of 0.2N HCl, and the mixture was maintained at 80° C. for three hours, then allowed to cool to thereby obtain a dispersion containing microcapsules of 3.8$\mu$in average size.

The dispersion thus obtained was filtrated and washed with ethanol to obtain microcapsules. The microcapsules thus obtained were dispersed in a solvent mixture composed of 330 parts of ethanol and 165 parts of n-propanol.

To the resultant, 25 parts of precipitated calcium carbonate of 1$\mu$in average particle size and 80 parts of ethyl cellulose No. 14 (product of Hercules Inc.) were added to thereby obtain a flexographic capsule ink composition.

(2) Preparation of a top sheet (pressure sensitive recording sheet of the present invention).

The surface of a wood free paper of 40 g/m$^2$ was printed in a 10 cm$\times$10 cm spot with the above capsule ink composition at a printing speed of 80 m/minute and in an amount to be 2.5 g/m$^2$ after dried by Business-form printer to thereby obtain a top sheet.

(3) Preparation of a bottom sheet.

A dispersion was prepared by pulverizing 65 parts of precipitated calcium carbonate, 20 parts of zic oxide, 15 parts of a molten mixture (80/20 in composition ratio) of zinc 3,5-di(alpha-methylbenzl) salicylate and alpha-methylstyrene/styrene copolymer, 5 parts (as solid content) of aqueous solution of polyvinyl alcohol and 300 parts of water in a ball mill for 24 hours. To the dispersion thus obtained, 20 parts (as solid content) of carboxy-modified styrene 1 butadiene copolymer latex was added to thereby obtain a coating composition containing a color acceptor.

Onto the surface of a wood free paper of 40 g/m$^2$, the resultant coating composition was applied in an amount to be 5 g/m$^2$ after dried by an air-knife coater, whereby a bottom sheet is obtained.

COMPARATIVE EXAMPLE 1

The procedures for the preparation of the top sheet in Example 1 were repeated, except that alkyldiphenyl ethane containing phenylxylyl ethane as the main constituent (trade name: HISOL SAS-296, product of Nippon Petrochemicals Co., Ltd.) was used in an amount of 100 parts in place of the 100 parts of benzyl toluene in Example 1, to thereby obtain a top sheet (comparative pressure sensitive recording sheet).

COMPARATIVE EXAMPLE 2

The procedures for the preparation of the top sheet in Example 1 were repeated, except that alkylnaphthalene containing diisopropylnaphthalene as the main constituent (trade name: K-113, product of Kureha Chemical Industry Co., Ltd.) was used in an amount of 100 parts in place of the 100 parts of benzyl toluene, to thereby obtain a top sheet (comparative pressure sensitive recording sheet).

EXAMPLE 2

The procedures for the preparation of the top sheet in Example 1 were repeated, except that a mixture composed of 50 parts of benzyl toluene and 50 parts of alkydiphenyl ethane (trade name: HISOL SAS-296, product of Nippon Petrochemicals Co., Ltd.) was used in place of the 100 parts of benzyl toluene in Example 1 to thereby obtain a top sheet (pressure sensitive recording sheet of the present invention).

EXAMPLE 3

The surface of a wood free paper of 40 g/m$^2$ was printed in a 10 cm×10 cm spot with the capsule ink composition prepared in Example 1 at a printing speed 100 m/minute and in an amount to be 2.3 g/m$^2$ after dried by a gravure printer to thereby obtain a top sheet (pressure sensitive recording sheet of the present invention).

COMPARATIVE EXAMPLE 3

The procedures of Example 3 were repeated, except that the capsule ink composition prepared in Comparative Example 1 was used, to thereby obtain a top sheet (comparative pressure sensitive recording sheet).

EVALUATIONS

Each of the top sheets obtained in Examples 1 to 3 and Comparative Examples 1 and 3 was evaluated with respect to its color developing property and clearness of a recorded image obtained.

(1) Color developing property:

The resultant top sheet (pressure sensitive recording sheet) was superposed on the bottom sheet obtained in Example 1, and the resultant assembly was set to a HERMES 700 EL type writer to obtain recorded images.

The recorded images thus obtained were evaluated for their optical density using a reflection densitometer (Macbeth RD 914).

The evaluated results obtained were as shown in Table 1.

(2) Image clearness.

The recorded images obtained in the above (1) were evaluated visually for their clearness.

The evaluated results obtained are as shown in Table 1.

The evaluated marks shown in Table 1 represent the following:

◎: the recorded images are excellent in clearness
○: the recorded images are desirably clear
×: the recorded images are not clear and practically unacceptable

TABLE 1

| | color developing property (optical density) | image clearness |
|---|---|---|
| Example 1 | 0.55 | ◎ |
| Example 2 | 0.50 | ◎ |
| Example 3 | 0.48 | ○ |
| Comparative Example 1 | 0.37 | X |
| Comparative Example 2 | 0.35 | X |
| Comparative Example 3 | 0.30 | X |

What we claim is:

1. A pressure sensitive recording sheet assembly comprising:

(a) a color former-containing sheet comprising
  (a-i) a substrate and
  (a-ii) a layer containing an electron-donative chromogenic material formed on said substrate (a-i) and (b) a color acceptor-containing sheet comprising
  (b-i) a substrate and
  (b-ii) a layer containing an electron-acceptive reactant material formed on said substrate (b-i), said electron-acceptive reactant material contained in said layer (b-ii) of said color acceptor-containing sheet (b) being capable of causing a color development upon contact with said electron-donative chromogenic material contained in said layer (a-ii) of said color former-containing sheet (a), wherein said layer (a-ii) of said color former-containing sheet a) comprises a microcapsule-containing layer formed by printing a non-aqueous capsule ink composition on the surface of said substrate (a-i) by means of flexographic printing or gravure printing, said capsule ink composition containing microcapsules, each of said microcapsules having a capsule wall made of a melamine-formaldehyde resin and containing a solution of said electron-donative chromogenic material dissolved in a hydrophobic medium containing benzyl toluene in an amount of at least 50% by weight of the sum of said hydrophobic medium, and each of said microcapsules being of 1.0 to 5.0 μm in the mean particle size, providing that none of said microcapsules contain an electron-acceptive reactant material.

2. A pressure sensitive recording sheet assembly according to claim 1, wherein the amount of said capsule ink composition in said layer (a-ii) applied on the substrate (a-i) is 0.5 to 10 g/m$^2$ on a dry weight basis.

* * * * *